US007771001B2

(12) United States Patent
Miyamoto

(10) Patent No.: US 7,771,001 B2
(45) Date of Patent: Aug. 10, 2010

(54) LIQUID DISCHARGE APPARATUS, METHOD FOR CONTROLLING THE SAME, AND PROGRAM FOR CONTROLLING THE SAME

(75) Inventor: Toru Miyamoto, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 208 days.

(21) Appl. No.: 12/218,022

(22) Filed: Jul. 10, 2008

(65) Prior Publication Data

US 2009/0015623 A1 Jan. 15, 2009

(30) Foreign Application Priority Data

Jul. 10, 2007 (JP) ..... 2007-181143

(51) Int. Cl.
*B41J 29/393* (2006.01)

(52) U.S. Cl. ..... 347/19; 347/81

(58) Field of Classification Search ..... 347/6, 347/7, 14, 19, 20, 81
See application file for complete search history.

(56) References Cited

U.S. PATENT DOCUMENTS 6,565,179 B1 * 5/2003 Bruch et al. ..... 347/19
2005/0195237 A1 * 9/2005 Anderson et al. ..... 347/19

FOREIGN PATENT DOCUMENTS

JP 2003-118149 4/2003

* cited by examiner

*Primary Examiner*—Thinh H Nguyen
(74) *Attorney, Agent, or Firm*—Nutter McClennen & Fish LLP; John J. Penny, V

(57) ABSTRACT

Disclosed is a liquid discharge apparatus that allows a discharge head to discharge liquid to a predetermined object. The apparatus includes the following elements. A plurality of discharge heads are detachable independently. A head switching circuit switches a target discharge head to another target discharge head among the discharge heads in a set switching order to allow the target discharge head to discharge liquid. A monitoring circuit monitors liquid discharge conditions of the respective discharge heads. The liquid discharge conditions of each discharge head include the frequency of use of the discharge head and the presence or absence of a failure in the discharge head. A life determining circuit determines the life of each discharge head on the basis of the result of monitoring by the monitoring circuit. A target head setting circuit sets each of the discharge heads having a remaining life to the target discharge head and sets the switching order so that the frequencies of use of the target discharge heads are imbalanced. A notifying circuit provides a notification for urging replacement of the discharge head whose remaining life is lower than a predetermined value.

7 Claims, 7 Drawing Sheets

LIQUID DISCHARGE APPARATUS, METHOD FOR CONTROLLING THE SAME, AND PROGRAM FOR CONTROLLING THE SAME

BACKGROUND

1. Technical Field

The present invention relates to liquid discharge apparatuses, methods for controlling the liquid discharge apparatus, and programs for controlling the liquid discharge apparatus and, in particular, relates to a liquid discharge apparatus having a plurality of independently detachable print head units, a method for controlling the liquid discharge apparatus, and a program for controlling the liquid discharge apparatus.

2. Related Art

Printing apparatuses, such as an ink jet printer, eject ink from nozzles to print. If a failure, e.g., clogging of any nozzle in a print head, occurs during printing, the typical printing apparatus detects the failure and issues an alarm or cleans the nozzles to eliminate the failure. In some cases, however, the failure is not eliminated by cleaning.

According to a known technique, a spare print head is provided for the printing apparatus in order to more reliably eliminate such a failure in the print head. Upon occurrence of a failure, the print head is replaced with the spare head. Alternatively, ink is discharged from nozzles of the spare print head instead of those of the print head in which clogging is detected. For example, JP-A-2003-118149 discloses this technique.

In the case where the printing apparatus includes the spare print head, as long as the print head, serving as a main print head, is replaced with the spare one upon occurrence of a failure in the main print head, the spare print head is not used until the end of the life of the main print head. Alternatively, as long as the nozzles of the spare print head are used only upon occurrence of a failure in the nozzles of the main print head, the main print head predominantly prints. In either case, the nozzles of the spare print head are not used unless a failure occurs. However, the lower frequency of use of the print head leads to drying of ink which remains in the nozzles of the print head. Unfortunately, the interiors of the nozzles may be caked with the remaining ink, causing the clogging of ink. Alternatively, ink particles may accumulate in the interiors of the nozzles, so that it is difficult to discharge ink from the nozzles.

SUMMARY

An advantage of some aspects of the invention is to provide a liquid discharge apparatus which includes a spare discharge head to extend the time between maintenances of each discharge head and which is capable of avoiding a state in which liquid discharge is not completed because any discharge head reaches the end of its life during liquid discharge, a method for controlling the liquid discharge apparatus, and a program for controlling the liquid discharge apparatus.

According to an aspect of the invention, a liquid discharge apparatus includes a plurality of discharge heads, a head switching circuit, a monitoring circuit, a life determining circuit, a target head setting circuit, and a notifying circuit.

In this structure, the monitoring circuit monitors liquid discharge conditions of each discharge head, the liquid discharge conditions including the frequency of use of the discharge head and the presence or absence of a failure in the discharge head. The life determining circuit determines the life of each discharge head on the basis of the result of monitoring. The target head setting circuit sets each discharge head, which is determined by the life determining circuit that the life of the head is remaining, to the target discharge head. In this instance, the target head setting circuit sets the switching order so that the frequencies of use of the target discharge heads are imbalanced. Therefore, in the case where the head switching circuit switches a target discharge head to another target discharge head among the discharge heads in accordance with a set switching order to allow the target discharge head to discharge liquid, the degree of wear of any discharge head is accelerated while all of the discharge heads are being used.

When it is determined that the remaining life of any discharge head is lower than a predetermined value, i.e., it is determined that any discharge head reaches the end of its life, the notifying circuit provides a notification for urging replacement of the discharge head which reaches the end of its life. In response to the notification, a user replaces the discharge head at desired time. During the wait for the replacement after the end of the life of the discharge head whose rate of wear was accelerated, alternatively, during the replacement, liquid discharge is performed using the other discharge heads with a slower rate of wear. Therefore, there is no period during which discharge is disabled due to the replacement of the discharge head. Even if any discharge head reaches the end of its life, it is unnecessary for the user to immediately replace the discharge head. The user may replace the discharge head at desired time.

It is preferable that the frequency of use be determined on the basis of at least one of cumulative operating time, the total number of discharge times, and the total number of sheets printed and the presence or absence of the failure be determined on the basis of success or failure of liquid discharge.

The cumulative operating time means cumulative time during which liquid discharge is performed by each discharge head. The total number of discharge times means the cumulative number of times of liquid discharge by each discharge head. The total number of sheets printed means the cumulative number of sheets (pages) printed by each discharge head. The success or failure of discharge means the ratio of the number of actual liquid discharge (or unsuccessful liquid discharge) times to the number of input liquid discharge instructions, or the number of unsuccessful liquid discharge times. As for the cumulative total number of sheets printed, the number of raster lines or the number of dots in printing may be accumulated and be converted into pages. In those liquid discharge conditions, the cumulative operating time, the total number of discharge times, and the total number of sheets printed are similar parameters representing the frequency of use of nozzles. Accordingly, the degree of wear can be monitored by monitoring at least one of those conditions.

It is preferable that the target head setting circuit set the switching order so as to increase the frequency of use of the discharge head having a shorter remaining life.

In other words, the discharge head having the shorter remaining life is allowed to discharge liquid at higher frequency, so that the discharge head having the shorter remaining life reaches the end of its life sooner. At that time, the remaining lives of the other discharge heads each having a relatively longer remaining life can be reliably maintained. Advantageously, there is no fear that all of the discharge heads simultaneously reach the ends of their lives. Furthermore, more time for replacement of the discharge head that reaches the end of its life can be provided. Accordingly, the user can replace the discharge head at desired time.

It is preferable that the discharge heads be combined into units each including a unit number of discharge heads such that each unit is independently detachable and the target head setting circuit set the switching order of the discharge heads so that the liquid discharge conditions of the units are imbalanced.

In other words, the discharge heads are constructed so that the frequencies of use of the units are imbalanced. Accordingly, when all of the discharge heads constituting one unit reach the ends of their lives, it is determined that the unit reaches the end of its life. When let N denote the life of each discharge head and let X denote the number of discharge heads constituting one unit, the life of the unit is expressed as N×X. Advantageously, the interval between the occurrences of discharge head replacement (i.e., the time between maintenances) can be extended.

It is preferable that the monitoring circuit monitor the liquid discharge conditions of each unit.

In other words, since the liquid discharge conditions of each unit are monitored by the monitoring circuit, the amount of information indicating the liquid discharge conditions held by the monitoring circuit can be reduced. Accordingly, the throughput or storage capacity can be saved. In the case where the liquid discharge conditions of each unit are monitored, the life of each discharge head or the life of each liquid discharge nozzle can be stochastically expected.

The above-described liquid discharge apparatus may include various modifications. For example, the liquid discharge apparatus may be incorporated into another apparatus or may be embodied using another method. The invention can also be realized as a liquid discharge system including the liquid discharge apparatus, a method including steps corresponding to the components of the apparatus, a program that allows a computer to realize functions corresponding to the components of the apparatus, and a computer-readable recording medium that stores the program. The liquid discharge system, the method for controlling the liquid discharge apparatus, the program for controlling the liquid discharge apparatus, and the recording medium that stores the program have the same advantages as those described above. As a matter of course, the foregoing preferable cases may be included in the above-described system, method, program, and recording medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

A liquid discharge apparatus according to an embodiment of the invention will be described below in the following order of:

1. Schematic Structure;
2. Monitoring Process;
3. Life Determining Process;
4. Print Head Switching Process; and
5. Modifications.

1. Schematic Structure

Figure 1:
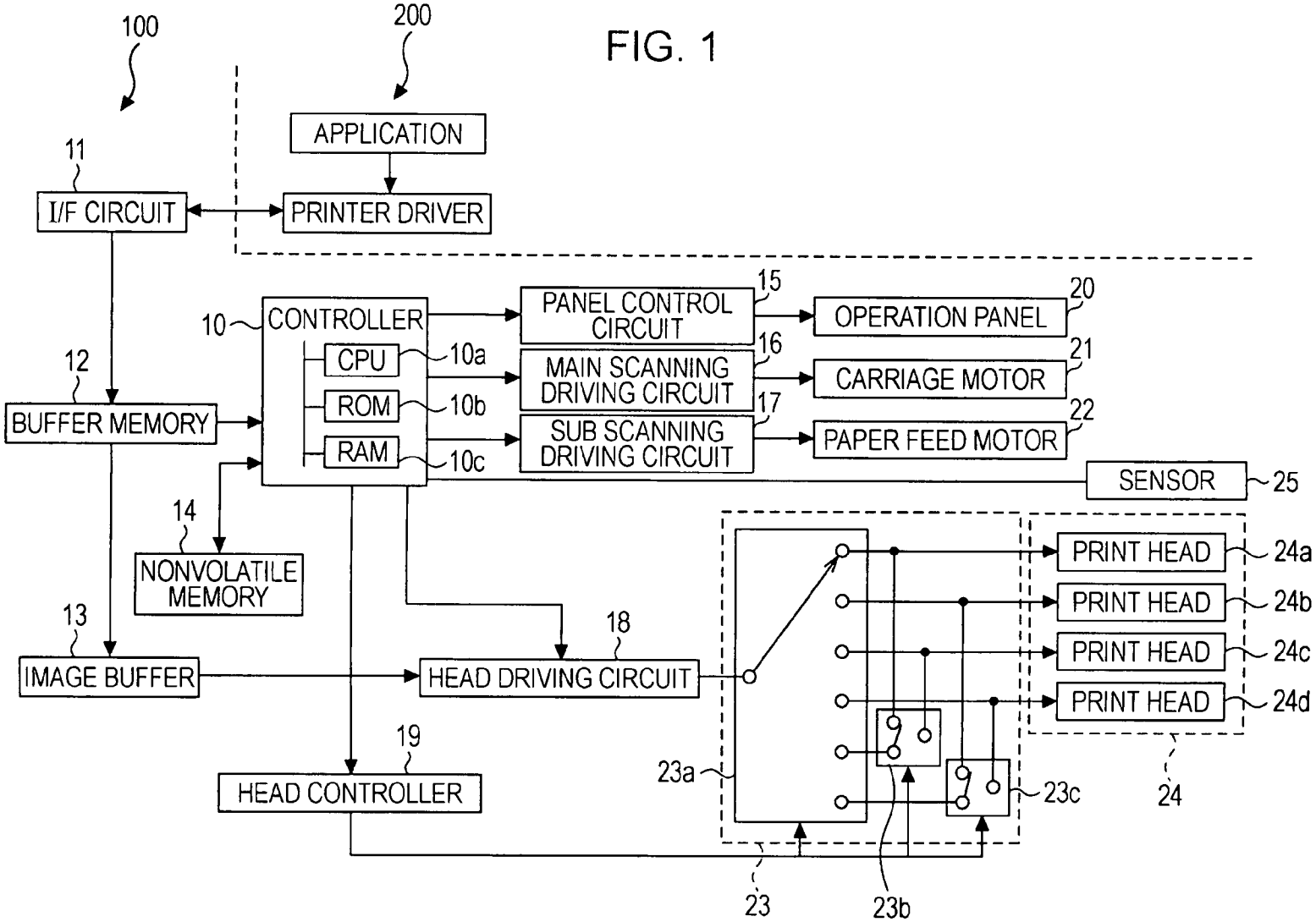
FIG. 1 is a block diagram illustrating an embodiment of the invention.

FIG. 1 is a block diagram illustrating a printer 100, serving as the liquid discharge apparatus according to the embodiment of the invention, and a computer 200, serving as an apparatus that inputs print data to the printer.

Referring to FIG. 1, the computer 200 corresponds to a personal computer. The computer 200 includes, as hardware, a CPU, a ROM, and a RAM, and further includes an external memory device as a hard disk. In addition, the computer 200 includes a keyboard and a mouse as input devices and further includes a display. In the computer 200, software organically collaborates with hardware, thus realizing predetermined functions. In this embodiment, the computer 200 includes, as software, a printer driver and an application.

The application outputs image data, representing an image comprising dot matrix picture elements of RGB, to the printer driver. The printer driver receives the image data and performs resolution conversion, color conversion, gray scale conversion, and rasterization on the image data.

In the resolution conversion, the resolution of color image data handled by the application is converted into a resolution at which the printer driver can handle the image data. In the color conversion, respective dot data blocks constituting the image data in RGB are converted into dot data blocks in CMYK (C: cyan, M: magenta, Y: yellow, K: black), i.e., CMYK data. The gray scale conversion is a halftoning process of converting a CMYK gray scale level of each dot to express an image as a distribution of dots, serving as ink droplets. In this process, head driving data blocks for depositing ink at a recording density after conversion are generated.

After that, the head driving data blocks are rasterized, that is, the head driving data blocks are sorted so that among the data blocks arranged in the main scanning direction (in which a print head reciprocates), the data blocks to be simultaneously used are simultaneously buffered in the printer 100. The rasterization allows data blocks arranged several dots apart from each other in the sub scanning direction (sheet feeding direction) to be simultaneously printed. Consequently, the use of discharge nozzles arranged several dots apart from one another in the sub scanning direction enables printing simultaneously using data blocks arranged several dots apart from one another in the sub scanning direction. If discharge nozzles are arranged with the same pitch as that between raster lines, rasterization is not needed. After rasterization, print data containing predetermined additional information, such as image resolution, is generated and is then output to the printer 100 through an interface (I/F), so that the printer 100 prints.

The structure of the printer 100 will now be described with reference to FIG. 1. The printer 100 is driven under the control of a controller 10. The controller 10 includes, for example, an application specific integrated circuit (ASIC). The printer 100 includes the controller 10, an interface (I/F) circuit 11, a buffer memory 12, an image buffer 13, a nonvolatile memory 14, a panel control circuit 15, a main scanning driving circuit 16, a sub scanning driving circuit 17, a head driving circuit 18, and a head controller 19. The ASIC is connected to a sensor 25 that monitors a discharge state of each nozzle in a print head.

The I/F circuit 11 functions as an interface between the printer 100 and the printer driver in the computer. The I/F circuit 11 stores print data and various commands received from the printer driver into the buffer memory 12 and also transmits a command received from the controller 10 through the buffer memory 12 to the printer driver.

The buffer memory 12 temporarily stores print data and various commands. Under the control of the controller 10, print data blocks (image data) of respective color components in the print data stored in the buffer memory 12 are sequentially read from the buffer memory 12 and are stored into the image buffer 13.

The controller 10 is connected to the main scanning driving circuit 16 that drives a carriage motor 21, the sub scanning driving circuit 17 that drives a paper feed motor 22, the head driving circuit 18 that drives a print head set 24, the panel control circuit 15, and the head controller 19 that controls the destination of a print-head driving voltage output from the head driving circuit 18, that is, determines which of print heads 24*a* to 24*d* is supplied with the driving voltage.

A ROM 10*c* of the controller 10 and the nonvolatile memory 14 store a program executed by the controller 10 and data used in the program. In the controller 10, a CPU 10*a* reads program data stored in the ROM 10*c* or the nonvolatile memory 14 and develops the read data on a RAM 10*b*. Thus, the controller 10 executes the program to control an operation of the printer 100.

The controller 10 reads necessary information among the print data and the various commands stored in the buffer memory 12 and generates signals for controlling the main scanning driving circuit 16, the sub scanning driving circuit 17, and the panel control circuit 15 on the basis of the information. In response to the received control signals, the main scanning driving circuit 16 and the sub scanning driving circuit 17 drive the carriage motor 21 and the paper feed motor 22 on the basis of various signals output from the controller 10, respectively.

The head driving circuit 18 receives a control signal, synchronized with the control signal for controlling the main scanning driving circuit 16, output from the controller 10. In response to the control signal, the head driving circuit 18 reads print data (image data) of each color component every raster line from the image buffer 13 and drives ink discharge sections of the print head set 24 in accordance with the read data.

Consequently, while a carriage driven by the carriage motor 21 is reciprocated in the main scanning direction, ink droplets are discharged from nozzles of the print head set 24 at predetermined timing. In addition, a recording sheet of paper (recording medium) is fed synchronously with the reciprocation of the carriage, so that printing is performed on the recording sheet.

The panel control circuit 15 is electrically connected to an operation panel (operation device or user interface) 20. The operation panel 20 has operation keys, such as a power switch and a print start switch, and a display screen including, for example, liquid crystal. When a user operates any operation key of the operation panel 20, the panel control circuit 15 outputs a key operation signal associated with the operated key to the controller 10. In response to the key operation signal, the controller 10 performs a process associated with the key operation. In addition, the panel control circuit 15 performs various displays related to printing on the display screen of the operation panel 20 on the basis of a control signal supplied from the controller 10.

The sensor 25 monitors ink discharge by each ink discharge nozzle, detects the presence or absence of ink discharged from each nozzle, and outputs data indicating the result of detection to the controller 10. The sensor 25 may have the following configuration: A light emitting device and a photodetector are arranged on opposite sides of each nozzle for discharging ink in order to detect a change in light intensity caused by an ink droplet passing between the light emitting device and the photodetector. The operation of each nozzle is confirmed on the basis of the detected change. Upon receiving the result of detection, the controller 10 compares print data output to each print head with the result of detection, thus confirming a state of each nozzle, for example, a fact that ink is not discharged due to nozzle clogging or a failure in the print head even though an ink discharge instruction is issued.

In this embodiment, the print head set 24 includes a plurality of print heads 24*a* to 24*d*. Each print head includes a plurality of ink cartridges corresponding to inks of different colors (e.g., cyan (C), magenta (M), yellow (Y), and black (K)) and a plurality of nozzle lines corresponding to the respective color inks. Each print head discharges inks stored in the ink cartridges as ink droplets from the respective nozzle lines to form an image on a print sheet.

Figure 2:
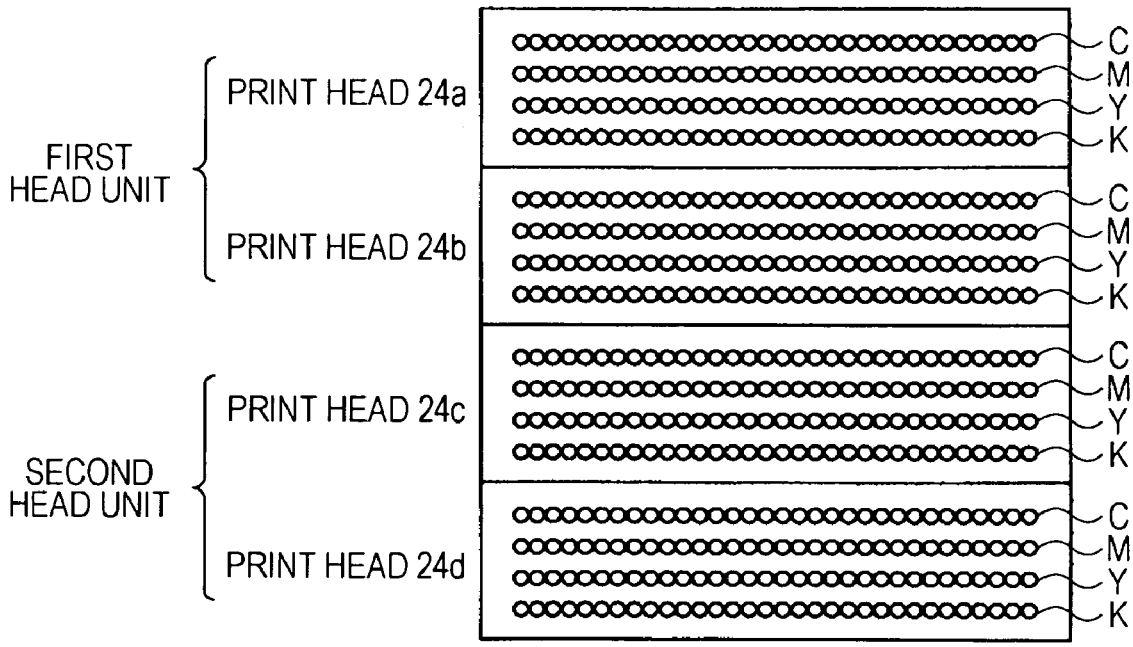
FIG. 2 is a diagram explaining head units.

Referring to FIG. 2, as for the print heads in accordance with the embodiment, the print heads are combined into units. Specifically, the print heads 24*a* and 24*b* constitute a first head unit and the print heads 24*c* and 24*d* constitute a second head unit. Accordingly, the print heads are not individually detached. The print head units are independently detachable.

A switching circuit 23 that operates under the control of the head controller 19 is disposed between the print head set 24 and the head driving circuit 18. The switching circuit 23 includes a head selecting switch 23*a* and weighting switches 23*b* and 23*c*. The head selecting switch 23*a* selects any one of terminals A to F and connects the selected terminal to a terminal connected to the head driving circuit 18. For example, the head driving circuit 18 are sequentially connected to the terminals A to F, so that the print head, which is allowed to discharge inks, can be switched to another one every unit print data.

The weighting switches 23*b* and 23*c* increase the frequency with which a driving signal output from the head driving circuit 18 is supplied to any of the print heads 24*a* to 24*d*. More specifically, the weighting switch 23*b* switches the terminal E between the print heads 24*a* and 24*c* to connect the terminal E to any one of the print heads. The weighting switch 23*c* switches the terminal F between the print heads 24*b* and 24*d* to connect the terminal F to any one of the print heads. Those weighting switches 23*b* and 23*c* can increase the frequency with which an ink discharge instruction is supplied to any of the print heads 24*a* and 24*b* or the frequency with which an ink discharge instruction is supplied to any of the print heads 24*c* and 24*d*.

2. Monitoring Process

Figure 3:
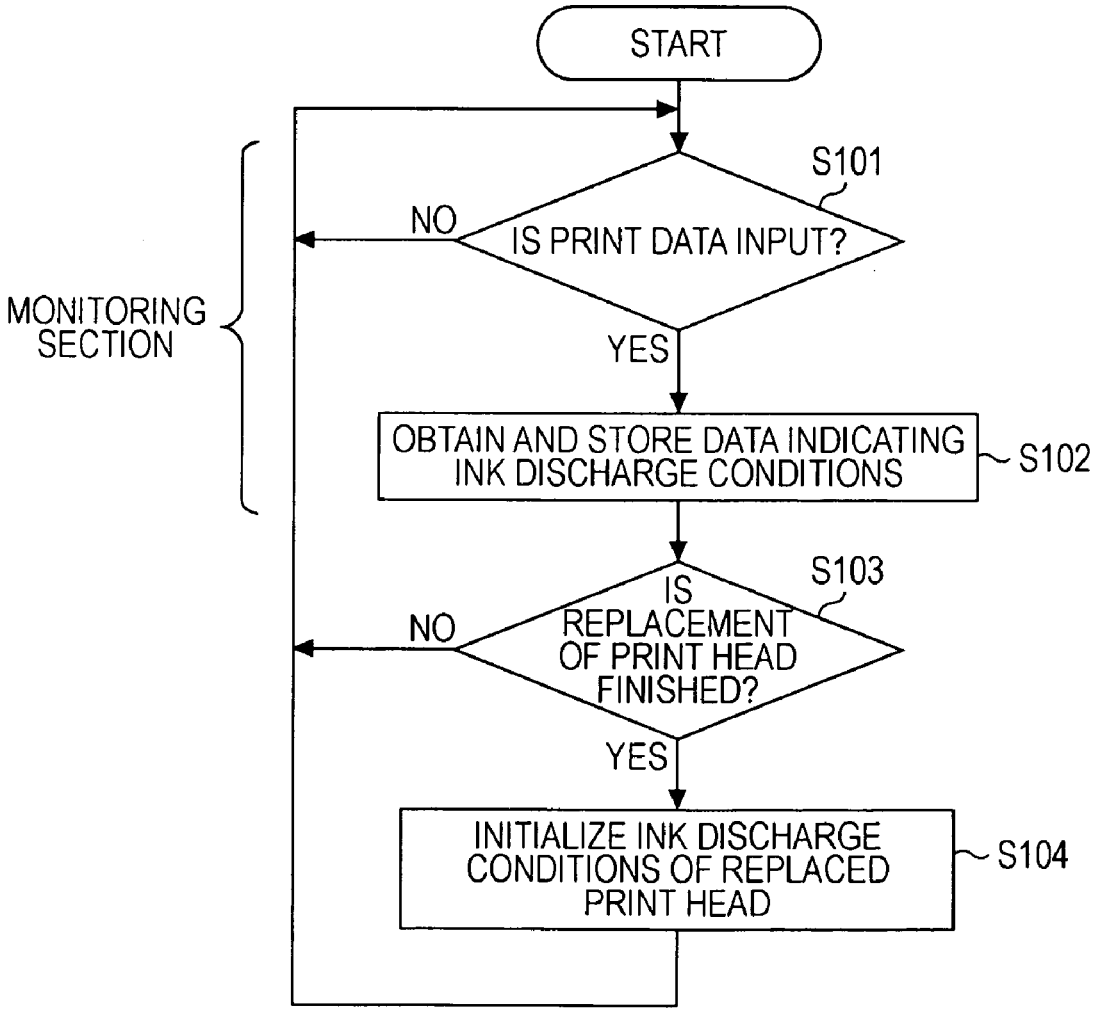
FIG. 3 is a flowchart of a monitoring process.

A monitoring process of monitoring ink discharge conditions will be described below with reference to a flowchart of FIG. 3. The monitoring process is always carried out while the printer 100 is turned on.

Upon starting the process, a determination is made in step S101 as to whether a print job is input. If the print job is input, ink discharge is performed. Accordingly, the process proceeds to step S102. In step S102, data indicating ink discharge conditions is obtained and is then stored. If any print job is not input, it is unnecessary to monitor ink discharge conditions. Step S101 is repeated until a print job is input.

In this instance, the ink discharge conditions include, for example, the operating time of each print head, the number of discharge times of each ink discharge nozzle, the number of sheets printed by each print head, and the success or failure of discharge of each print head. The operating time of each print head, the number of discharge times of each ink discharge nozzle, and the number of sheets printed by each print head each represent the frequency of use. As long as at least one of those conditions is monitored, it is sufficient to determine the degree of wear of each print head. It is therefore unnecessary to obtain all of the ink discharge conditions.

In the monitoring process, a discharge instruction supplied to each of the nozzles constituting each print head is monitored. Counting the number of discharge instructions obtains the number of discharge times, the operating time, and the number of printed sheets. In the monitoring process, an output of the sensor 25 is also monitored. An ink discharge instruction and the presence or absence of actual ink discharge of each nozzle which has received the ink discharge instruction are checked, so that the success or failure of each ink discharge is obtained as a nozzle discharge condition.

The obtained ink discharge conditions are stored into the nonvolatile memory 14 such that the obtained conditions are added to the stored ink discharge conditions. Therefore, the nonvolatile memory 14 stores, as ink discharge conditions, the cumulative operating time of each print head, the total number of discharge times of each ink discharge nozzle, the total number of sheets printed by each print head, and the history of the successes or failures of each print head.

As for the total number of ink discharge times of each ink discharge nozzle, the number of ink discharge times may be counted for each nozzle and the total number may be stored. Alternatively, the number of ink discharge times summed for each color in each print head, for each print head, or for each head unit may be stored. The reason is as follows: If the total number of discharge times summed for each print head or for each head unit is used, the life of each print head can be expected on the basis of the general ratio used in printing with CMYK color inks. As long as the use ratio of each of CMYK colors may be stored, the life of each print head can also be expected on the basis of the stored use ratios.

The cumulative operating time and the total number of printed sheets may be summed for each head unit and be stored. When such parameters summed for each print head or each head unit are stored, the capacity of the nonvolatile memory can be saved and the throughput of a life determining process, which will be described later, can be reduced.

As for the success or failure of discharge, the presence or absence of discharge in a nozzle supplied with an ink discharge instruction may be detected by, for example, a photosensor and the ratio of the number of successful (or unsuccessful) discharge times to the total number of discharge times may be stored.

In step S103, a determination is made as to whether any print head is replaced to new one. When the replacement is finished, the process proceeds to step S104. In step S104, ink discharge conditions related to the replaced print head stored in the nonvolatile memory 14 are reset. If any print head is not replaced, steps S101 and S102 are repeated.

As for the replacement of any print head, for example, a switch may be provided for a head attachment unit and the replacement may be detected on the basis of a signal generated upon detachment of the print head. Alternatively, an ID (e.g., a serial number) unique to each print head may be obtained and the replacement may be detected by comparing the IDs of print heads before and after the replacement. If an ink tank is integrated with each print head, the amount of ink remaining in each ink tank may be obtained from a ROM included in the ink tank. The replacement can be detected on the amounts of remaining ink.

The controller 10 which performs processing in steps S101 and S102 corresponds to a monitoring section.

3. Life Determining Process

Figure 4:
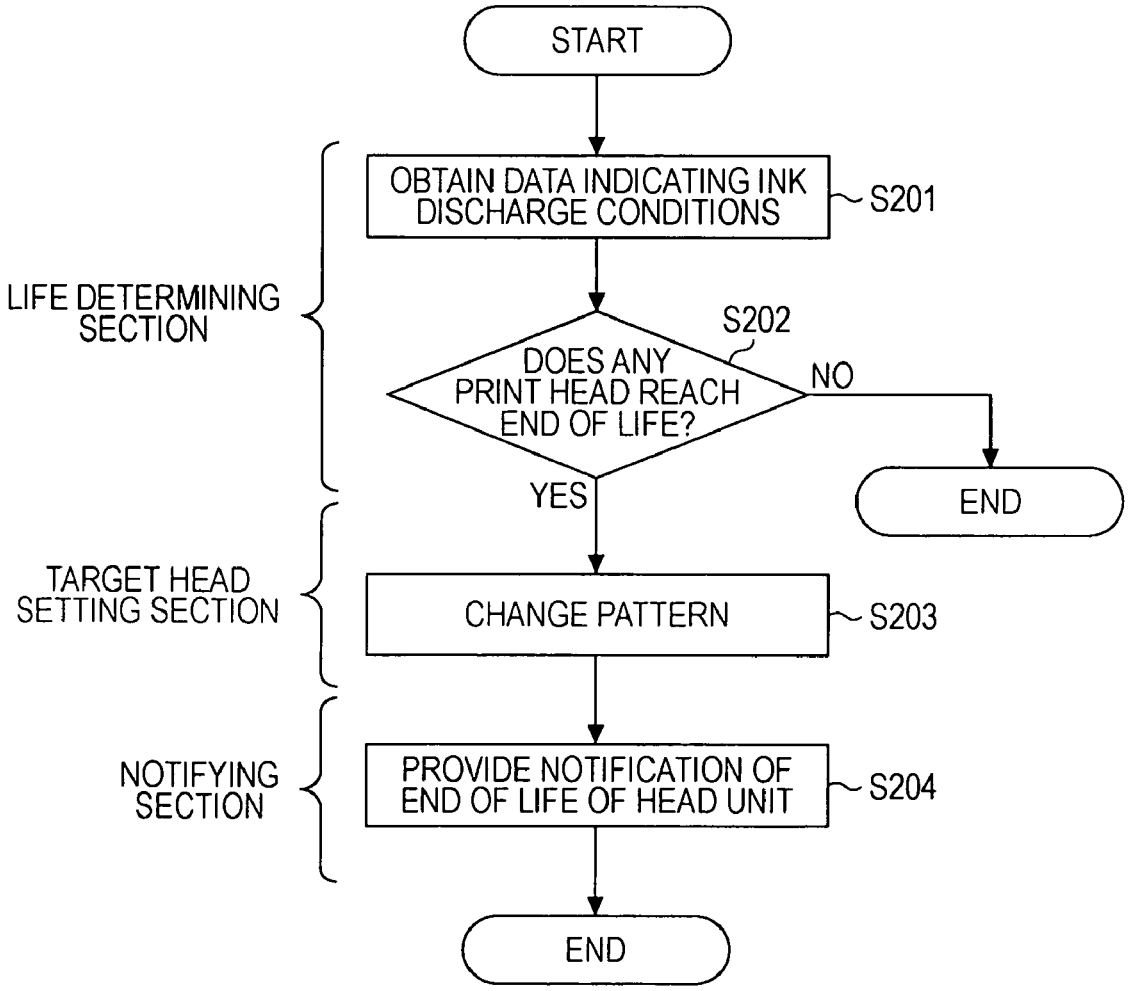
FIG. 4 is a flowchart of a life determining process.

The life determining process of determining the life of each print head will be described with reference to a flowchart of FIG. 4. This process is repeatedly performed at predetermined time intervals while the printer 100 is turned on.

Upon starting the process, in step S201, the data indicating the ink discharge conditions (the result of monitoring) stored in the nonvolatile memory 14 by the above-described monitoring process is obtained.

In step S202, the life of each print head is determined. When it is determined that any print head reaches the end of its life, the process proceeds to step S203. When it is determined that any print head does not reach the end of its life, the process is terminated.

In this process, the life of each print head is determined on the basis of the above-described ink discharge conditions. A determination is made as to whether the cumulative operating time, the total number of printed sheets, or the total number of discharge times exceeds a preset threshold. In a case where normal discharge is disabled due to a malfunction, e.g., clogging of any discharge nozzle or a failure in any print head, if the number of times in which normal discharge is disabled in the corresponding print head (alternatively, the ratio of this number of times to the total number of discharges) exceeds a predetermined threshold, it is determined that the print head reaches the end of its life (i.e., the remaining life reaches zero). In the above-described determinations, when at least one of the above-described parameters exceeds the threshold, it is determined that the corresponding print head reaches the end of its life.

In this step, the user may be notified of the remaining life or the degree of wear of each print head. For example, the cumulative operating time, the total number of printed sheets, or the total number of discharge times of each print head is subtracted from the preset threshold, thus obtaining the remaining life. The user is notified of the remaining life or the degree of wear of each print head. In this case, it is unnecessary to consider the number of times in which normal discharge is disabled due to a failure, since the failure suddenly occurs. The remaining life may be weighted, e.g., reduced at a predetermined rate in accordance with the ratio of unsuccessful discharges to successful discharges or the number of unsuccessful discharges.

In step S203, a switching pattern is changed. The switching pattern is changed by changing setting of the switching pattern stored in the nonvolatile memory 14. At that time, the remaining life of the first head unit is compared to that of the second head unit. The pattern setting is changed so that the frequency of use of any head unit having a shorter remaining life is higher than that of the other unit having a longer remaining life. For example, when the remaining life of the first head unit is shorter, a pattern A is selected. When the remaining life of the second head unit is shorter, a pattern B is selected. The patterns A and B will be described later. If any one of the head units reaches the end of its life, a pattern in which the other head unit alone is used is selected. For example, when the first head unit reaches the end of its life, a pattern D is selected. When the second head unit reaches the end of its life, a pattern C is selected. The patterns D and C will be described later.

In step S204, the user is notified that any head unit reaches the end of its life. The notification is performed by outputting a control signal for allowing the panel control circuit 15 to perform predetermined display. The computer 200 may perform this notification. Any of steps S203 and S204 may be performed first. When the switching pattern is changed and the notification of the end of the life of any head unit is finished, this process is terminated.

The controller 10 which performs steps S201 and S202 corresponds to a life determining section, the controller 10 which performs step S203 corresponds to a target head setting section, and the controller 10 which performs step S204 corresponds to a notifying section.

4. Print Head Switching Process

Figure 5:
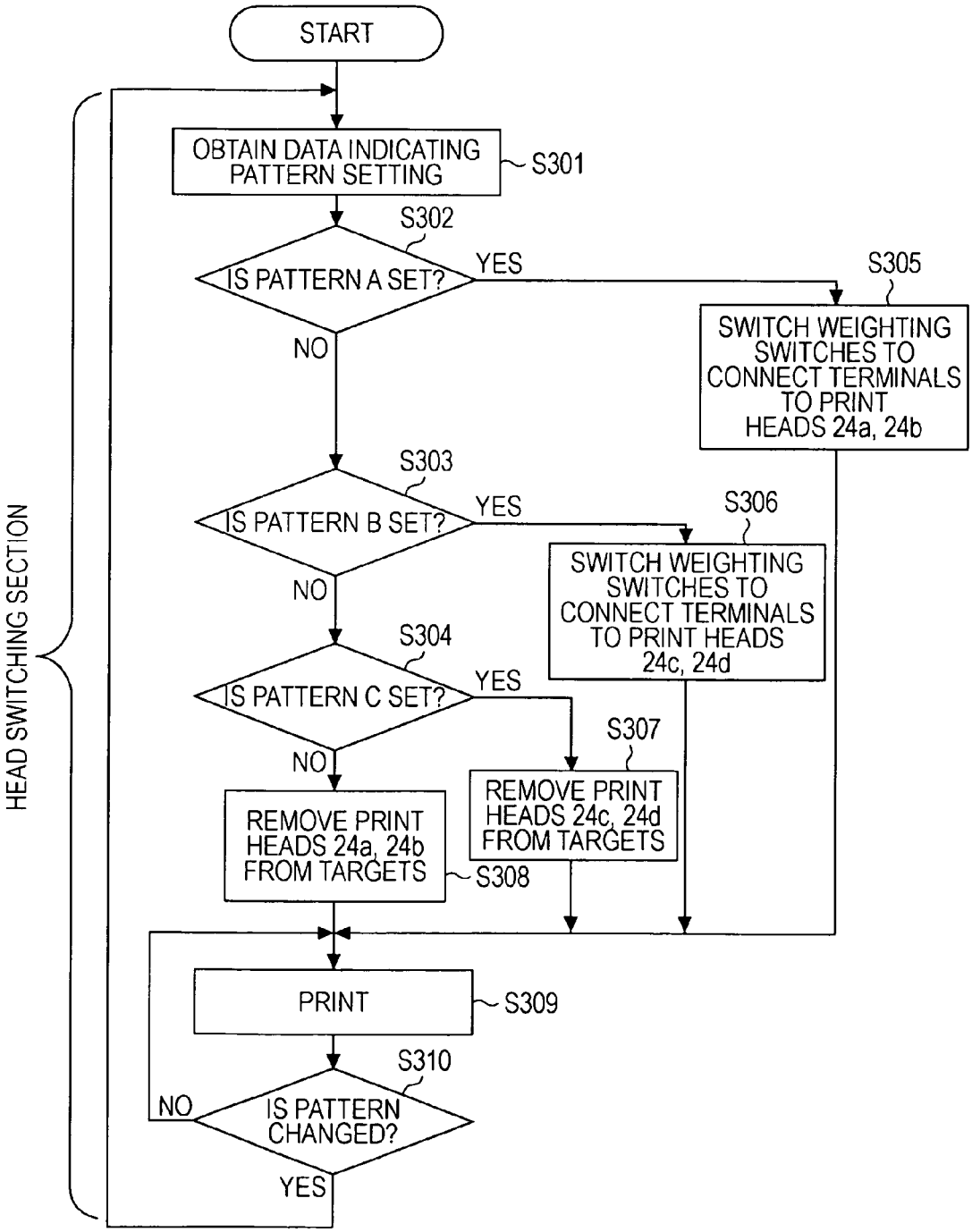
FIG. 5 is a flowchart of a print head switching process.

A print head switching process using the switching circuit 23 will be described with reference to a flowchart of FIG. 5. The print head switching process is performed by the controller 10. For example, this process is started upon turn-on of the printer 100 as a trigger event. The process may be started at the time when print data is supplied to the printer 100 or when a print start instruction is given through the operation panel.

Upon starting the process, data indicating the current setting of the switching pattern is obtained in step S301. The pattern setting is stored in, for example, the nonvolatile memory 14. The setting data can be obtained from a predetermined address in the nonvolatile memory 14.

In printing in accordance with this embodiment, the pattern A in which the frequency of use of the first head unit (the print heads 24*a* and 24*b*) increases, the pattern B in which the frequency of use of the second head unit (the print heads 24*c* and 24*d*) increases, the pattern C in which only the second head unit is used in order to replace the first head unit, and the pattern D in which only the first head unit is used in order to replace the second head unit are available. The pattern is appropriately switched between those patterns A to D to perform printing. A specific switching order in each pattern will now be described below.

In the pattern A, while the head selecting switch 23*a* is sequentially switched between the terminals A to F, the terminals E and F are connected to the print heads 24*a* and 24*b*, respectively. In the pattern B, while the head selecting switch 23*a* is sequentially switched between the terminals A to F in a manner similar to the pattern A, the terminals E and F are connected to the print heads 24*c* and 24*d*, respectively. In the pattern C, the head selecting switch 23*a* is alternately switched between the terminals connected to the print heads 24*a* and 24*b*. In the pattern D, the head selecting switch 23*a* is alternately switched between the terminals connected to the print heads 24*c* and 24*d*.

In each of steps S302, S303, and S304, a determination is made as to which pattern is set. First, in step S302, a determination is made as to whether the pattern A is set. When the pattern A is set, the process proceeds to step S305. In step S305, the switching operation in the pattern A is performed. If the pattern A is not set, the process proceeds to step S303.

In step S303, a determination is made as to whether the pattern B is set. When the pattern B is set, the process proceeds to step S306. In step S306, the switching operation in the pattern B is performed. If the pattern B is not set, the process proceeds to step S304.

In step S304, a determination is made as to the pattern C is set. When the pattern C is set, the process proceeds to step S307. In step S307, the switching operation in the pattern C is performed. If the pattern C is not set, it is determined that the pattern D is set. The process proceeds to step S308. The switching operation in the pattern D is performed in step S308.

In each of steps S305, S306, S307, and S308, when the switching operation is finished, the process proceeds to step S309. In step S309, printing is performed. The order of head switching during printing is as described above. Various switching intervals are available in the head selecting switch. For example, the print head may be switched to the other one in the print head unit every unit print data (e.g., every predetermined number of raster lines, pages, sheets, or amount of data), every unit time period, or every unit amount of ink used. In the use of such switching timing, the degrees of wear of the respective print heads per switching can be made substantially uniform. Consequently, a variation in the ink discharge conditions per switching of one print head constituting each print head unit can be made substantially the same as that of the other one.

In step S310, a determination is made as to whether the switching pattern is changed. The change may be confirmed as follows. The above-described monitoring process may include interrupt processing in which notification is provided to the print head switching process upon changing the switching pattern. The change may be confirmed on the basis of the presence or absence of the notification. Alternatively, the change may be confirmed by again confirming the setting in the nonvolatile memory after a lapse of a predetermined time period from the setting confirmation in step S301. When the set pattern is changed, the process is returned to step S302 and the pattern is again set. When the set pattern is not changed, processing in step S309 is repeated.

The controller 10 which performs processing in steps S301 to S310 corresponds to a head switching section.

Figure 6:
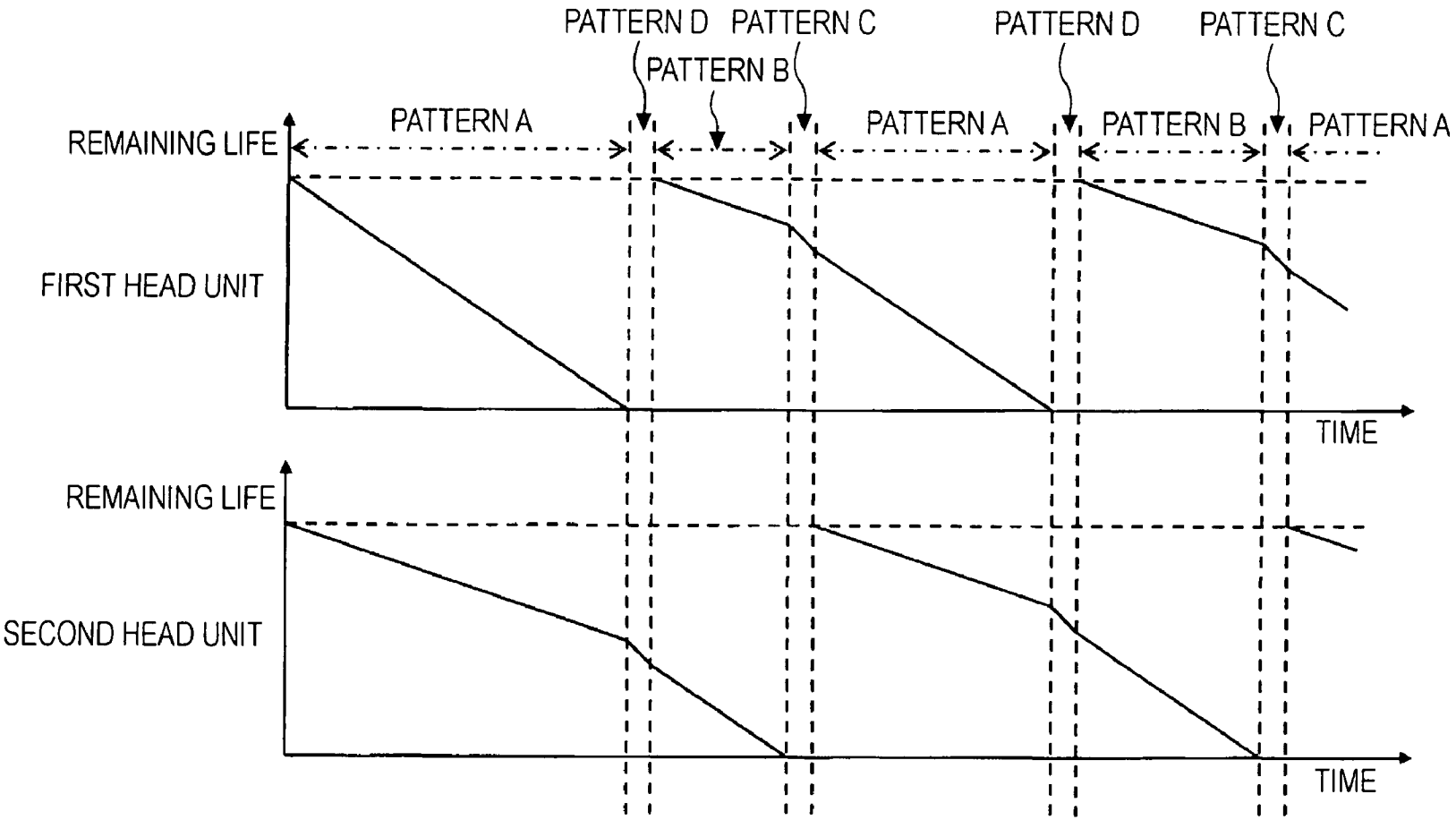
FIG. 6 is a timing diagram explaining fluctuations on the lives of the head units.
Figure 7:
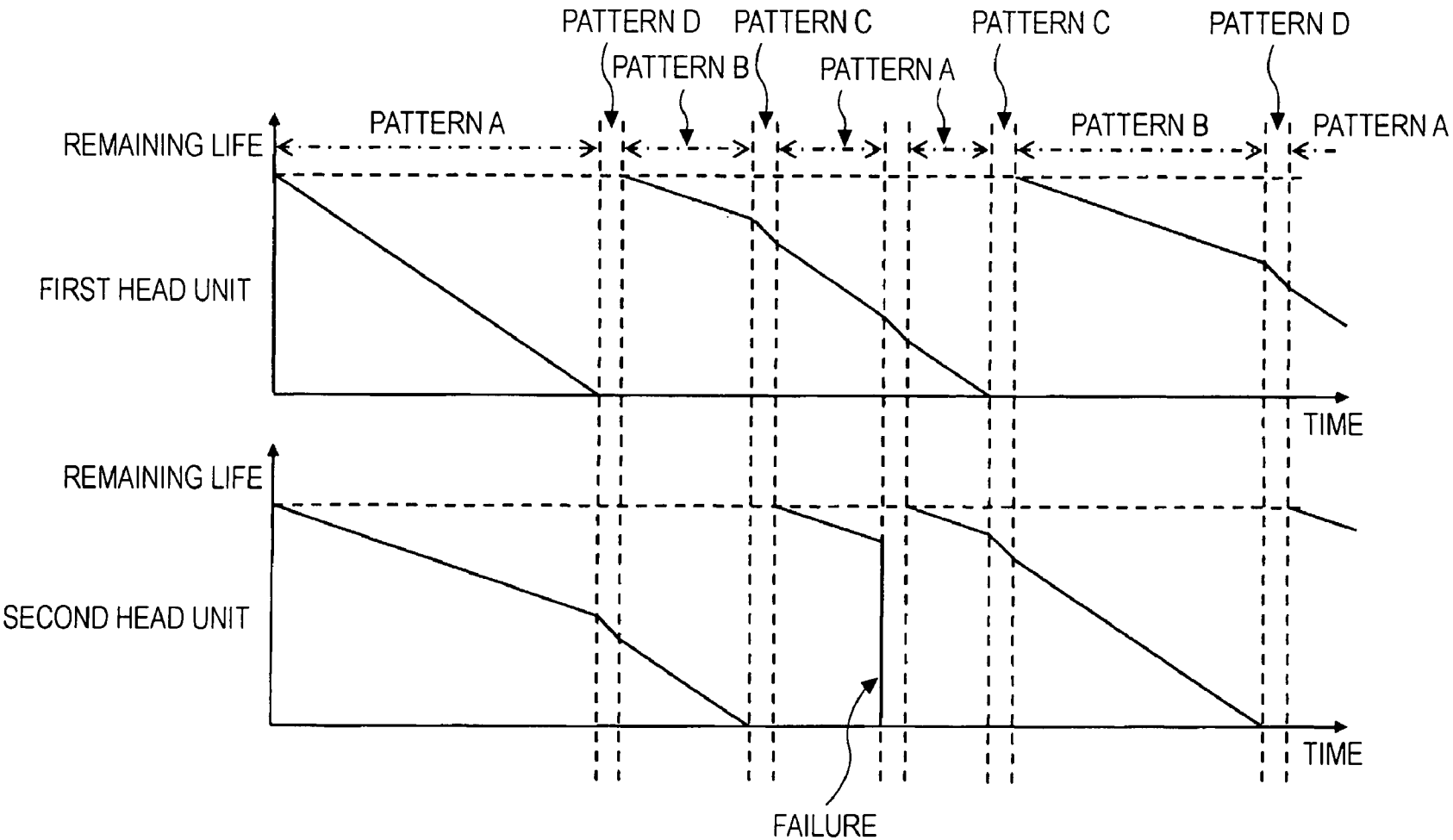
FIG. 7 is a timing diagram explaining the fluctuations on the lives of the head units.

The remaining life of each head unit which varies depending on the implementation of the above-described processes will be described with reference to timing diagrams of FIGS. 6 and 7. The timing chart of FIG. 6 shows a case where a failure, such as clogging of a print head unit, does not occur. The timing chart of FIG. 7 shows a case where a failure has occurred.

Referring to FIG. 6, when the pattern A is set as a switching pattern, the head selecting switch performs the switching operation so that the ratio of the number of use times of the first head unit to that of the second head unit is 2:1. Accordingly, the first head unit wears at a rate which is twice that of the second head unit, so that the first head unit reaches the end of its life soon. In the life determining process, therefore, it is determined that the first head unit reaches the end of its life. Thus, the pattern is changed to the pattern D in which printing is performed by only the second head unit. Simultaneously, a notification for urging the replacement of the first head unit is provided because the first head unit reaches the end of its life.

The second head unit alone entirely performs printing until the replacement of the first head unit is completed. Accordingly, the second head unit wears at a rate which is approximately three times higher than in the pattern A. Since a time period elapsed until the replacement of the head unit is completed is extremely shorter than that during which printing is performed using both the first and second head units, there is no fear that the second head unit immediately wears.

After the user replaces the first head unit in response to the notification, the monitoring section detects the replacement and clears (initializes) the ink discharge conditions of the first head unit stored in the nonvolatile memory 14. In the life determining process, the life of the first head unit is reset on the basis of the result of latest monitoring. Consequently, the switching pattern is changed to the pattern B in which the second head unit having a shorter remaining life is used preferentially.

After that, each time the life of any head unit reaches the end of its life, the pattern is switched to another pattern in which printing is performed using the other head unit and the head unit which reaches the end of its life is replaced. Since the use of the head units is started such that the first and second head units have the same remaining life, the length of the time period during which the pattern A is set is not equal to that during which the pattern B is set. After the switching between the patterns A to D is repeated, the time period during which the pattern A is set and that during which the pattern B is set gradually become equal to each other.

Referring to FIG. 7, a failure has occurred in the second head unit in the second pattern A. The life of the second head unit suddenly reaches zero. At that time, in the life determining process, it is determined that the second head unit reaches the end of its life and the pattern is changed to the pattern C in which only the first head unit performs printing. After completion of the replacement of the second head unit, the pattern A in which the first head unit having a shorter remaining life is preferentially used is again selected. After that, when the life of the first head unit reaches the end of its life because the first head unit wears, the first head unit is replaced and the print head switching process using the pattern B is performed.

5. Modifications

In the above-described embodiment, the case where the four print heads are combined into two pairs (units) has been described as an example. The total number of print heads and the number of print heads constituting a single head unit are not limited to those in the example. Various numbers are available.

In the foregoing embodiment, the piezo ink jet printer of the serial head type has been described as an example of the printer. A line head ink jet printer or a printer that prints images with another mechanism, such as a thermal printer or a dye sublimation printer, may be used.

In the foregoing embodiment, the ink jet printer (printing apparatus) that allows the print heads to discharge inks on the basis of input image data in order to print on a predetermined recording medium has been described as an example of the liquid discharge apparatus. The liquid discharge apparatus is not limited to this example. The liquid discharge apparatus may discharge liquid other than ink. For example, the invention is applicable to a liquid discharge apparatus, used in manufacturing a liquid crystal display, an electro luminescent (EL) display, or a surface emission display, for discharging liquid in which a material, e.g., a color material is distributed or dissolved, a liquid discharge apparatus, used in biochip manufacture, for discharging a bio-organic material, and a liquid discharge apparatus, used as a precision pipette, for discharging liquid as a specimen. In addition, the liquid discharge apparatus according to the embodiment of the invention may include an apparatus for discharging lubricating oil to a precision device, such as a watch or a camera, in a pinpoint manner, an apparatus for discharging transparent liquid resin, such as UV curable resin, on a substrate to form, for example, a micro hemispherical lens (optical lens) used in an optical communication device, an apparatus for discharging an acid or alkaline etching solution to etch a substrate, and an apparatus for discharging gel.

The invention is not limited to the foregoing embodiment and modifications. It should be understood that the invention includes various modifications, combinations, and alternations of the components disclosed in the foregoing embodiment and modifications, and various modifications, combinations, and alternations of the components well known in the art and disclosed in the foregoing embodiment and modifications.

What is claimed is:

1. A liquid discharge apparatus that allows a discharge head to discharge liquid to a predetermined object, the apparatus comprising:

a plurality of discharge heads detachable independently;

a head switching circuit that switches a target discharge head to another target discharge head among the discharge heads in a set switching order to allow the target discharge head to discharge liquid;

a monitoring circuit that monitors liquid discharge conditions of each discharge head, the liquid discharge conditions including the frequency of use of the discharge head and the presence or absence of a failure in the discharge head;

a life determining circuit that determines the life of each discharge head on the basis of the result of monitoring by the monitoring circuit;

a target head setting circuit that sets each of the discharge heads having a remaining life to the target discharge head and sets the switching order so that the frequencies of use of the target discharge heads are imbalanced; and a notifying circuit that provides a notification for urging replacement of the discharge head whose remaining life is lower than a predetermined value.

2. The apparatus according to claim 1, wherein the frequency of use is determined on the basis of at least one of cumulative operating time, the total number of discharge times, and the total number of sheets printed, and the presence or absence of a failure is determined on the basis of the success or failure of liquid discharge.

3. The apparatus according to claim 1, wherein the target head setting circuit sets the switching order so as to increase the frequency of use of the discharge head having a shorter remaining life.

4. The apparatus according to claim 1, wherein the discharge heads are combined into units each including a unit number of discharge heads and are constructed such that each unit is independently detachable, and the target head setting circuit sets the switching order of the discharge heads so that the frequencies of use of the units are imbalanced.

5. The apparatus according to claim 4, wherein the monitoring circuit monitors the frequency of use of each unit.

6. A method for controlling a liquid discharge apparatus that allows a discharge head to discharge liquid to a predetermined object, the apparatus including a plurality of discharge heads detachable independently, the method comprising:

switching a target discharge head to another target discharge head among the discharge heads in a set switching order to allow the target discharge head to discharge liquid;

monitoring liquid discharge conditions of the respective discharge heads, the liquid discharge conditions of each discharge head including the frequency of use of the discharge head and the presence or absence of a failure in the discharge head;

determining the life of each discharge head on the basis of the result of monitoring;

setting each of the discharge heads having a remaining life to the target discharge head and setting the switching order so that the frequencies of use of the target discharge heads are imbalanced; and providing a notification for urging replacement of the discharge head whose remaining life is lower than a predetermined value.

7. A program for controlling a liquid discharge apparatus that allows a discharge head to discharge liquid to a predetermined object, the apparatus including a plurality of discharge heads detachable independently, the program allowing the apparatus to perform:

a head switching function of switching a target discharge head to another target discharge head among the discharge heads in a set switching order to allow the target discharge head to discharge liquid;

a monitoring function of monitoring liquid discharge conditions of the respective discharge heads, the liquid discharge conditions of each discharge head including the frequency of use of the discharge head and the presence or absence of a failure in the discharge head;

a life determining function of determining the life of each discharge head on the basis of the result of monitoring;

a target head setting function of setting each of the discharge heads having a remaining life to the target discharge head and setting the switching order so that the frequencies of use of the target discharge heads are imbalanced; and a notifying function of providing a notification for urging replacement of the discharge head whose remaining life is lower than a predetermined value.

* * * * *